US006186823B1

(12) United States Patent
Obata et al.

(10) Patent No.: US 6,186,823 B1
(45) Date of Patent: Feb. 13, 2001

(54) ELECTRICAL CONNECTOR

(75) Inventors: Hiroyuki Obata, Kanagawa; Tsukasa Ito, Saitama; Takashi Futatsugi, Tokyo; Yoshinori Watanabe, Kanagawa, all of (JP)

(73) Assignee: The Whitaker Corporation, Wilmington, DE (US)

( * ) Notice: Under 35 U.S.C. 154(b), the term of this patent shall be extended for 0 days.

(21) Appl. No.: 09/310,022

(22) Filed: May 11, 1999

(30) Foreign Application Priority Data

May 11, 1998 (JP) ..... 10-127865

(51) Int. Cl.[7] ..... H01R 12/24
(52) U.S. Cl. ..... 439/496
(58) Field of Search ..... 439/496, 77, 78, 439/497

(56) References Cited

U.S. PATENT DOCUMENTS 4,975,068 * 12/1990 Squires ..... 439/67
6,039,600 * 3/2000 Etters et al. ..... 439/496

OTHER PUBLICATIONS

Japanese Patent Publication No. 9–237666.

* cited by examiner

*Primary Examiner*—Lincoln Donovan
*Assistant Examiner*—Brian S. Webb

(57) ABSTRACT

The present invention provides an electrical connector (1) which has a flexible printed circuit (FPC) and slider, in which the manufacturing cost is low, and the assembly work is simple. The electrical connector (1) is equipped with an insulating housing (10) having a plurality of electrical terminals (21, 22), an FPC (30) has a plurality of conductive pads formed on its surface and both sections (31, 32) of which are electrically connected to the terminals (21, 22), and a slider (50) is clamped within the FPC (30). A lower surface of second section (32) of the FPC (30) is folded back and fastened to a lower surface of the first section (31) of the FPC (30). Prescribed terminals (21) are electrically connected to conductive pads **(35*a*) on an upper surface of the first section (31) of the FPC (30), while prescribed terminals (22) of the other terminals (22) are electrically connected to conductive pads (35*b*) on an upper surface of the second section (32) of the FPC (30). The housing (10)** is a single integral member which is formed by molding from an insulating resin.

9 Claims, 4 Drawing Sheets

80
1
60
13
13
14
10
11
70
45
21
30
12
50
70

ELECTRICAL CONNECTOR

FIELD OF THE INVENTION

The present invention relates to an electrical connector equipped with a flexible printed circuit, both ends of which are connected to electrical terminals protruding from a dielectric housing, and a slider which is clamped by the flexible printed circuit and which is inserted between rows of electrical contacts of a mating electrical connector so that conductive pads of the flexible printed circuit are caused to electrically engage the rows of contacts.

BACKGROUND OF THE INVENTION

Electrical connector 100 disclosed in Japanese Patent Publication No. 9-237666 and shown in FIG. 6 is equipped with an insulating housing 110 including upper and lower housing members 111, 112, upper electrical terminals 121 and lower electrical terminals 122 in rows which protrude from respective wall surfaces 113, 114 of the housing members 111, 112, a flexible printed circuit (FPC) 130 has conductive pads (not shown) on an upper surface, and both ends of which are respectively electrically connected to the upper and lower terminals 121, 122, and a slider 140 is clamped within sections of the FPC 130 and is inserted between the rows of electrical contacts 161, 162 of a mating electrical connector 160 so that the conductive pads electrically engage the rows of contacts 161, 162. The slider 140 is used in order to facilitate the engagement of the conductive pads of the FPC 130 with the rows of contacts 161, 162 of the mating connector 160. A supporting member 150 fastens the upper and lower housing members 111, 112, and regulates the movement of the slider 140 in the vertical direction.

Next, the method of assembly of the electrical connector 100 will be described. First, for each of the upper and lower terminals 121, 122 of the upper and lower housing members 111, 112, the upper terminals 121 and conductive pads disposed on an upper surface of one end 131 of the FPC 130, and the lower terminals 122 and conductive pads disposed on an upper surface of the other and 132 of the FPC 130, are connected by soldering via a base plate 133 attached to an undersurface of the first end 131 of the FPC 130 and a base plate 134 attached to the undersurface of the second end 132 of the FPC 130. Next, the slider 140 is clamped from above and below by the sections of the FPC 130, and the upper and lower housing members 111, 112 are fastened by means of the supporting member 150 while both ends of the slider 140 are also supported by the supporting member 150. As a result, the electrical connector 100 is completely assembled.

However, in conventional electrical connector 100, since the housing 110 is constructed from upper and lower housing members 111, 112, the number of parts required in order to construct the housing 110 is increased, so that parts control is a problem. Furthermore, since the housing members 111, 112 must be formed using a different mold, mold costs are increased.

On the other hand, if the housing 110 is formed as a single integral housing, parts control is facilitated and mold costs are decreased. In such a case, however, since soldering connections must be made while the slider 140 is clamped between sections of the FPC 130 when the conductive pads disposed on the upper surface of one end 131 of the FPC 130 and the conductive pads disposed on the upper surface of the other end 132 of the FPC 130 are respectively connected by soldering the upper and lower terminals 121, 122 thereto, this connection work, and by extension the work of assembling the electrical connector 100 is time consuming and therefore expensive.

Accordingly, the object of the present invention is to provide an electrical connector which has an FPC and slider, in which the manufacturing cost is low, and the assembly work is simple.

SUMMARY OF THE INVENTION

The electrical connector of the present invention is equipped with an insulating housing having a plurality of electrical terminals that protrude from a wall of the housing, a flexible printed circuit, both sections of which are connected to the electrical terminals and which has a plurality of conductive pads formed on a surface thereof, and a slider is clamped by the flexible printed circuit is inserted between rows of electrical contacts of a mating electrical connector so that the conductive pads electrically engage the rows of electrical contacts, a lower surface of a second section of the flexible printed circuit is folded back and fastened to a lower surface of a first section of the flexible printed circuit, and selected terminals among the plurality of terminals are connected to the conductive pads on an upper surface of the first surface of the flexible printed circuit, while the other terminals among the plurality of terminals are electrically connected to the conductive pads on an upper surface of the second section of the flexible printed circuit via the first section of the flexible printed circuit.

It is effective if the selected terminals among the plurality of terminals and the other terminals among the plurality of terminals are arranged in different rows, and the housing is a single integral housing of an insulating resin material.

It is much more effective if positioning pin holes which allow the passage of positioning pins that position the second section and first section of the flexible printed circuit when the lower surface of the second section is fastened to the lower surface of the first section are located in the first section and second section of the flexible printed circuit.

BRIEF DESCRIPTION OF THE DRAWINGS

An embodiment of the present invention will now be described by way of example with reference to the accompanying drawings in which:

FIG. 4A is a top plan view, and FIG. 4B is a bottom view.

FIG. 5A is a plan view, FIG. 5B is a front view, and FIG. 5C is a side view looking from the right of FIG. 5B.

DETAILED DESCRIPTION OF THE INVENTION

Figure 1:
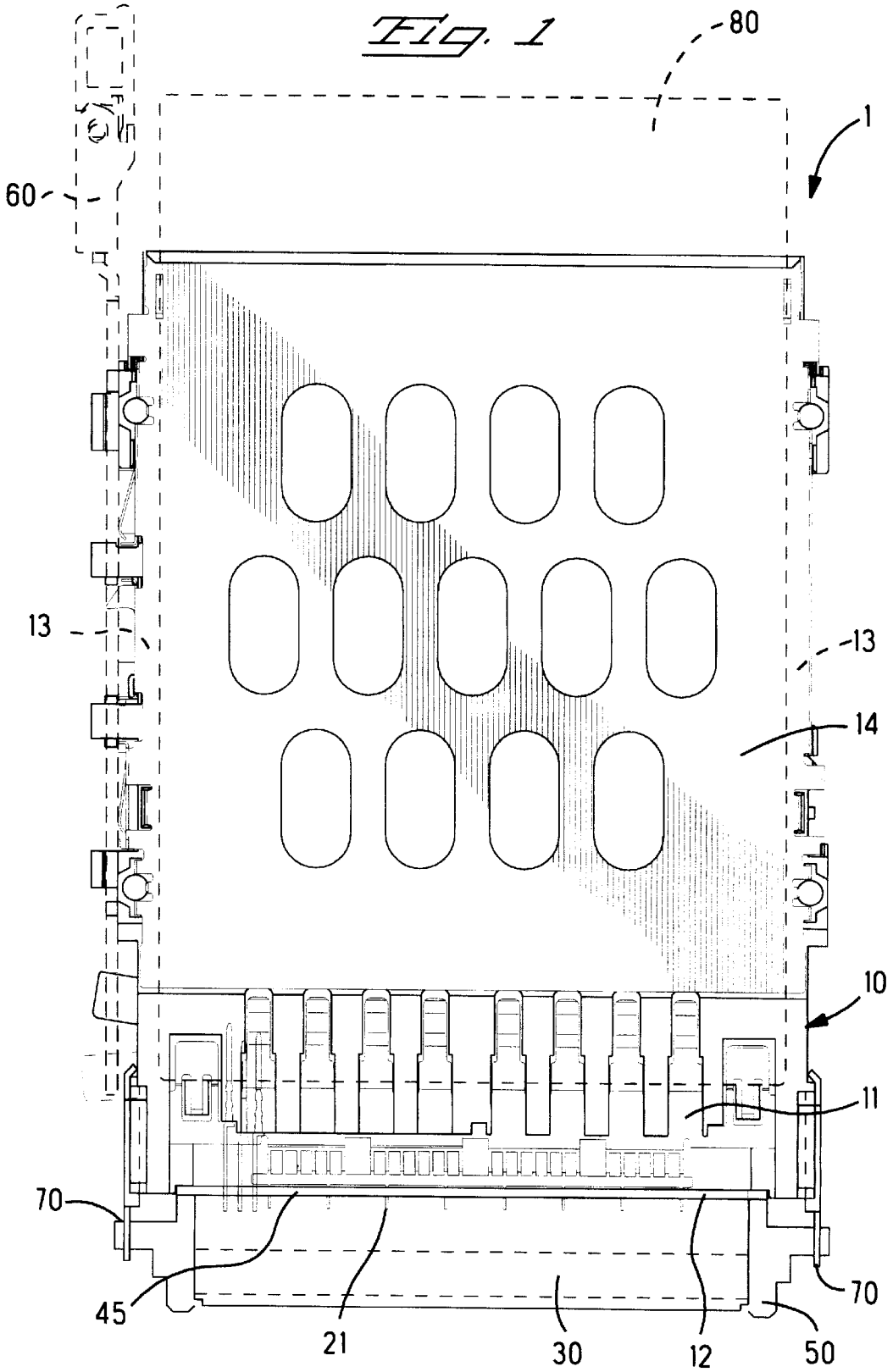
FIG. 1 is a top plan view of an electrical connector of the present invention.
Figure 2:
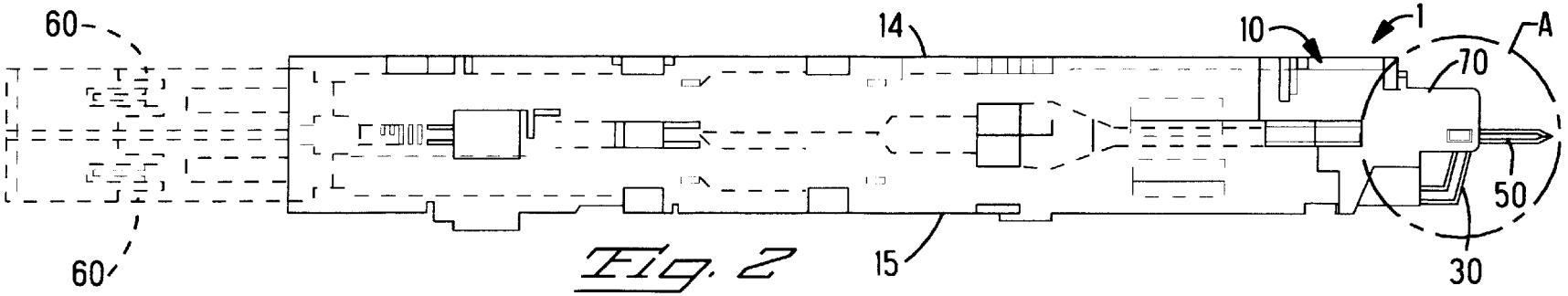
FIG. 2 is a side view of the electrical connector shown in FIG. 1 looking from the left thereof.
Figure 3:
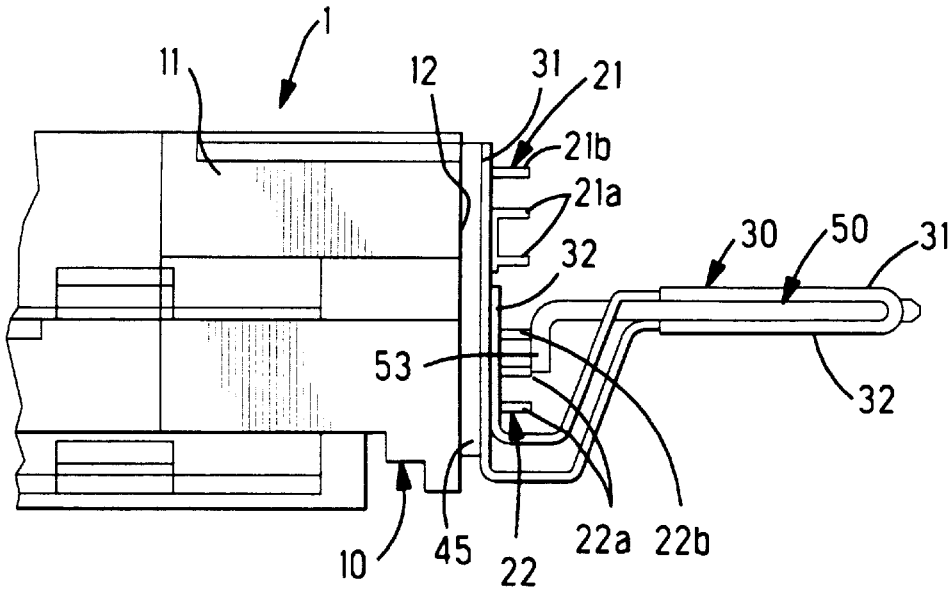
FIG. 3 is an enlarged view of the area indicated by arrow A in FIG. 2; however, the supporting member is omitted.
Figure 6:
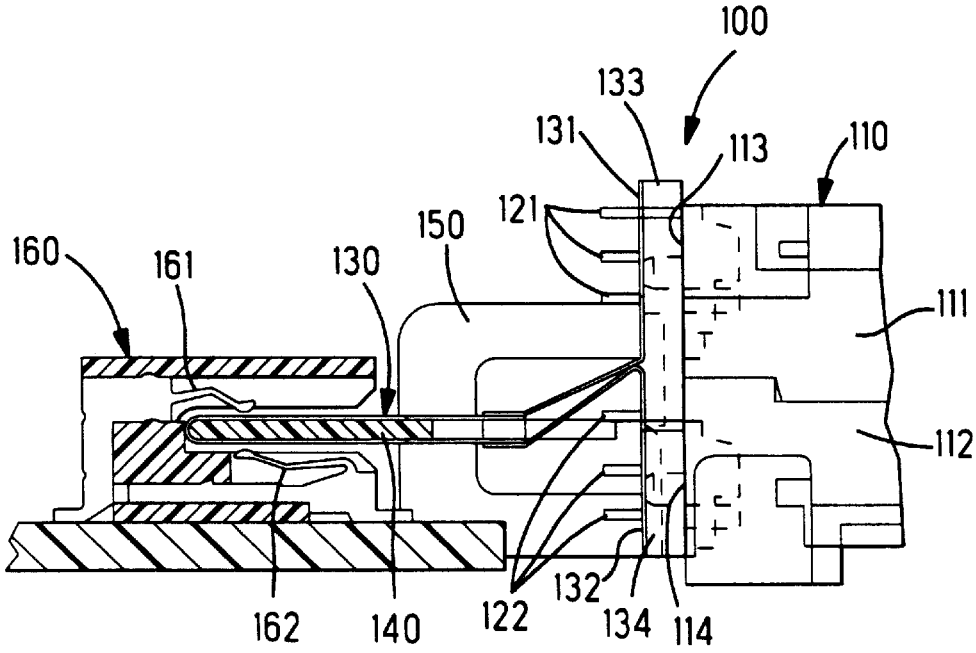
Fig. 6 (Prior Art)
FIG. 6 is a part cross-sectional view showing the main parts of a conventional electrical connector.

In FIGS. 1 through 3, electrical connector 1 is equipped with an insulating housing 10, a plurality of upper rows of electrical terminals 21 and lower rows of electrical terminals 22 protruding from wall 12 of the housing 10, FPC (flexible printed circuit) 30, both ends 31, 32 of which are connected to the upper rows of terminals 21 and lower row of terminals 22, a slider 50 is clamped between sections of the FPC 30 and is inserted between rows of electrical contacts of a mating electrical connector (not shown) so that the conductive pads on the FPC 30 are caused to electrically engage the rows of contacts, and a supporting member 70 is attached to the housing 10 and regulates the movement of the slider 50 in a vertical direction.

The housing 10 is a single integral member formed by molding from a suitable insulating resin material, and it is equipped with a connector section 11, having a wall 12 from which the upper and lower rows of electrical terminals 21 and 22 protrude, and card guides 13 extending from both ends of the connector section 11. A pair of metal shells 14, 15 are attached to upper and lower ends of the housing 10; upper and lower card-accommodating slots are capable of accommodating two PC cards 80 such as memory cards, and they are delineated by the card guides 13 of the housing 10 and the pair of metal shells 14, 15.

The upper rows of electrical terminals 21 are disposed within the wall 12 of the connector section 11 of the housing 10 facing the upper card-accommodating slot, while the lower rows of electrical terminals 22 are also disposed within the wall 12 of the connector section 11 facing the lower card-accommodating slot. Furthermore, the PC card 80 accommodated in the upper card-accommodating slot is electrically connected with the upper rows of terminals 21, while the PC card 80 accommodated in the lower card-accommodating slot is electrically connected with the lower rows of terminals 22. The PC cards 80 accommodated in the respective card-accommodating slots are ejected by means of ejection mechanisms 60.

The upper rows of terminals 21 include upper rows of signal terminals 21*a*, which are arranged in a staggered configuration, and a single upper row of ground terminals 21*b*. The lower rows of terminals 22 similarly include lower rows of signal terminals 22*a*, which are arranged in a staggered configuration, and a single lower row of ground terminals 22*b*.

Figure 4A:
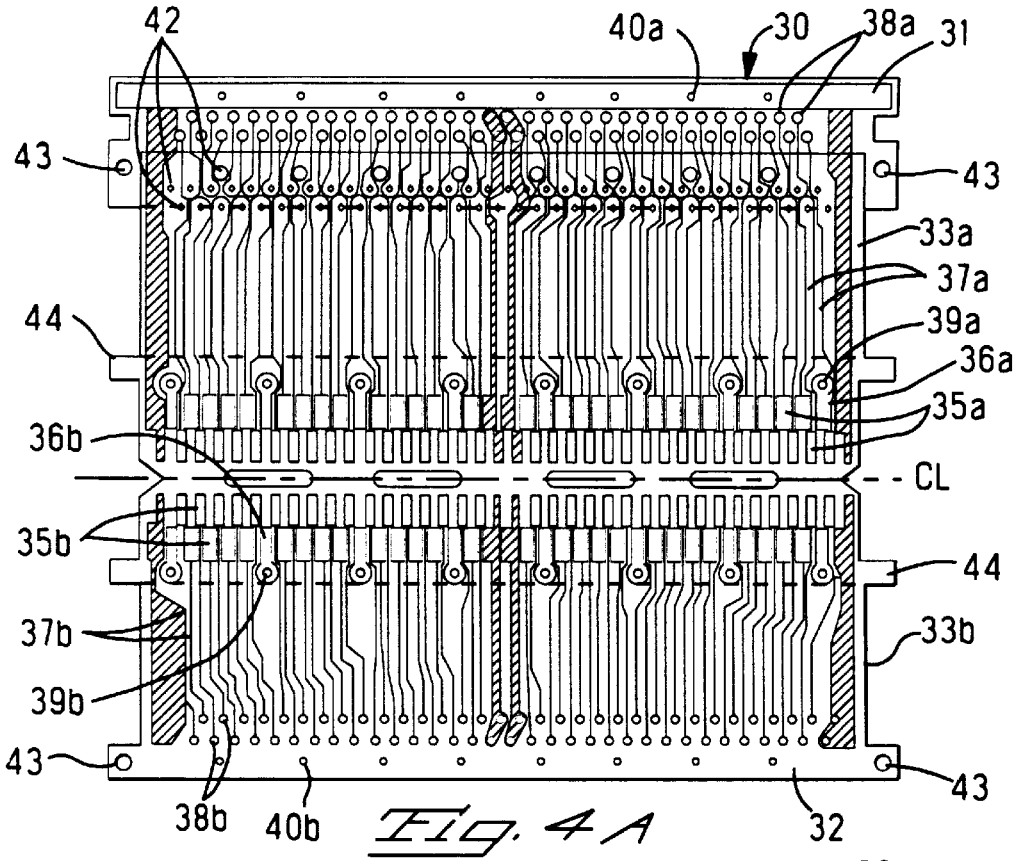
FIGS. 4A and 4B show a flexible printed circuit used in the electrical connector shown in FIG. 1.
Figure 4B:
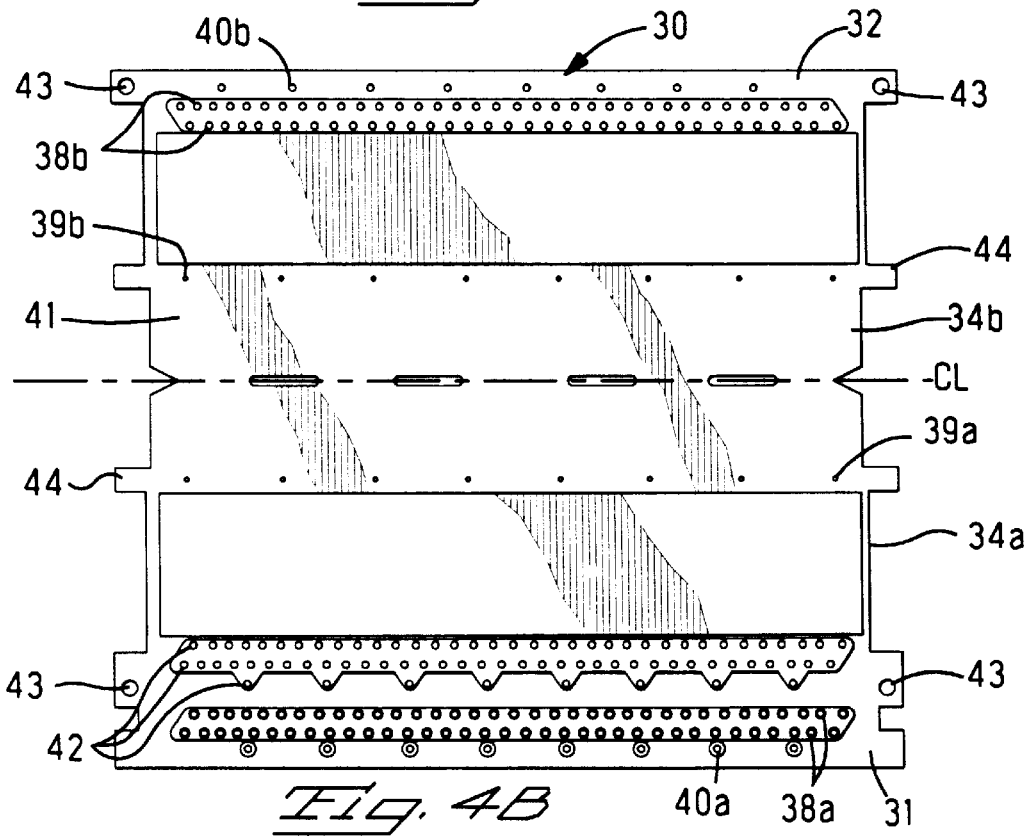

FIGS. 4A and 4B show the FPC 30 in an unfolded state wherein the FPC 30 is a substantially rectangular member of a suitable plastic material which possesses flexibility, and it has a first section 31 and a second section 32. A plurality of signal conductive pads 35*a* are lined up at a prescribed pitch in a staggered configuration along the lateral direction in the vicinity of roughly the central part, a plurality of signal through-holes 38*a* are lined up at a prescribed pitch in a staggered configuration along the lateral direction in the vicinity of an outer end of the first section 31, and a plurality of conductive paths 37*a* electrically connect the signal conductive pads 35*a* and the signal through-holes 38*a*; all of these are disposed on an upper surface 33*a* of the first section 31 of the FPC 30 with respect to the center line CL. Furthermore, a plurality of ground conductive pads 36*a* are also disposed on the upper surface 33*a* of the first section 31 of the FPC 30 with respect to the center line CL. The ground conductive pads 36*a* are lined up at a prescribed pitch in a single row along the lateral direction between specified adjacent signal conductive pads 35*a*, and a ground through-hole 39*a* is located in one end of each of the ground conductive pads 36*a*. Furthermore, a plurality of ground through-holes 40*a*, which are lined up at a prescribed pitch in a single row along the edge, are located in the first section 31 of the FPC 30. The upper rows of signal terminals 21*a* of the upper rows of terminals 21 are electrically connected to the signal through-holes 38*a*, and the upper row of ground terminals 21*b* of the upper rows of terminals 21 are electrically connected to the ground through-holes 40*a*.

Similarly, a plurality of signal conductive pads 35*b* are lined up at a prescribed pitch in a staggered configuration along the lateral direction in the vicinity of roughly the central part, a plurality of signal through-holes 38*b* are lined up at a prescribed pitch in a staggered configuration along the lateral direction in the vicinity of an outer end, and a plurality of conductive paths 37*b* electrically connect the signal conductive pads 35*b* and the signal through-holes 38*b*, all of these are also disposed on an upper surface 33*b* of the second section 32 of the FPC 30 with respect to the center line CL. Furthermore, a plurality of ground conductive pads 36*b* are also disposed on the upper surface 33*b* of the second section 32 of the FPC 30 with respect to the center line CL. The ground conductive pads 36*b* are lined up at a prescribed pitch in a single row along the lateral direction between specified adjacent signal conductive pads 35*b*, and a ground through-hole 39*b* is located in one end of each of the ground conductive pads 36*b*. Furthermore, a plurality of ground through-holes 40*b*, which are lined up at a prescribed pitch in a single row along the edge, are located in the second section 32 of the FPC 30. The lower rows of signal terminals 22*a* of the lower rows of terminals 22 are electrically connected to the signal through-holes 38*b*, and the lower row of ground terminals 22*b* of the lower rows of terminals 22 are electrically connected to the ground through-holes 40*b*.

Furthermore, a plurality of lower rows of terminal through-holes 42, which are aligned with the signal through holes 38*b* and ground through-holes 40*b* in the second section 32 of the FPC 30 when the second section 32 is folded back so that the lower surface 34*b* of the second section 32 is folded back onto the lower surface 34*a* of the first section 31, are located in the first section 31 of the FPC 30. Furthermore, a plurality of positioning-pin holes 43, which allow the passage of positioning pins therethrough (not shown) on the second section 32 and first section 31 when the lower surface 34*b* of the second section 32, is fastened to the lower surface 34*a* of the first section 31, are located in the left and right sides of the first section 31 and second section 32 of the FPC 30.

A ground surface 41 is located over substantially the entire area of each of the lower surfaces 34*a*, 34*b* of the FPC 30, except for the locations of the signal through-holes 38*a*, 38*b* and the lower rows of terminal through-holes 42. The ground through-holes 39*a*, 39*b* and 40*a*, 40*b* show electrical continuity with the ground surface 41.

An insulating base plate 45, which has through-holes (not shown) and are located in positions corresponding to the signal through-holes 38*a*, ground through-holes 39*a*, and lower rows of terminal through-holes 42, and into which the upper rows and lower rows of terminals 21 and 22 are inserted, is fastened to the upper surface 33*a* of the first section 31 of the FPC 30 (see FIG. 3).

Figure 5A:
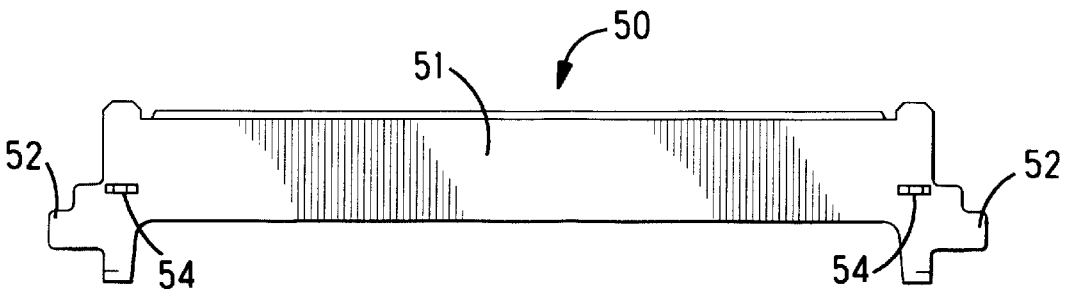
FIGS. 5A–5C show a slider used in the electrical connector shown in FIG. 1.
Figure 5B:
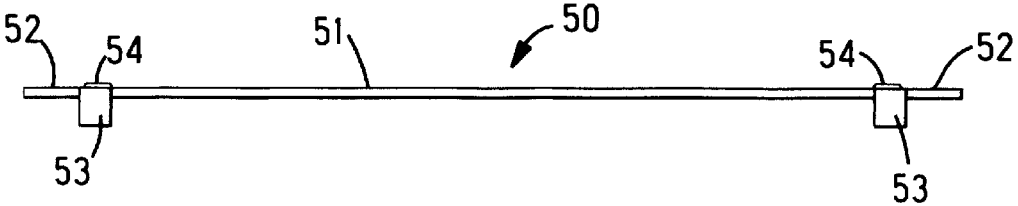
Figure 5C:
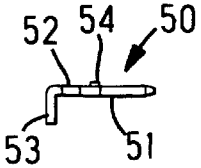

FIG. 5 shows the slider 50 which is equipped with a flat member 51 that is clamped between the lower surfaces 34*a*, 34*b* of the first section 31 and second section 32 of the folded-back FPC 30, a pair of supporting projections 52 project from both ends of the flat member 51, and they are disposed in slots of the supporting members 70, and a pair of lugs 53, which are formed by being bent downwardly from a rear surface of the flat member 51 adjacent both ends thereof, and which are engaged by the wall 12 of the housing 10 when the slider 50 is inserted between the rows of contacts of the mating connector (not shown).

Next, the method used to connect both sections 31, 32 of the FPC 30 to the upper rows of terminals 21 and lower rows of terminals 22 will be described. First, after the flat member 51 of the slider 50 is placed on the lower surface 34*a* of the first section 31 of the FPC 30, the lower surface 34*b* of the second section 32 of the FPC 30 is folded back toward the lower surface of the first section 31, so that the slider 50 is clamped between the lower surfaces 34*a,* 34*b;* furthermore, the signal through-holes 38*b* and ground through-holes 40*b* in the second section 32 are aligned with the lower rows of terminal through-holes 42 in the first section 31, and the lower surface 34*b* of the second section 32 is adhesively fastened to the lower surface 34*a* of the first section 31. For example, a two-sided tape is used as the bonding means in this case. Here, positioning on the side of the first section 31 and positioning on the side of the second section 32 are accomplished by passing the positioning pins through the positioning-pin holes 43; accordingly, the lower surface 34*b* of the second section 32 can easily be adhesively fastened to the lower surface 34*a* of the first section 31. When the FPC 30 is folded back and adhesively fastened, a pair of protrusions 54, which protrude from an upper surface of the flat member 51 of the slider 50, are engaged with projecting members 44 projecting from the left and right sides of the FPC 30, so that the slider 50 is prevented from falling out of the FPC 30. Afterward, the upper rows of signal terminals 21*a* are passed through the signal through-holes 38*a* of the FPC 30, and the upper of ground terminals 21*b* are passed through the ground through-holes 40*a;* furthermore, the lower rows of signal terminals 22*a* are passed through the signal through-holes 38*b* and the lower rows of terminal through-holes 42 in the FPC 30, and the lower row of ground terminals 22*b* are passed through the ground through-holes 40*b* and the lower rows of terminal through-holes 42 in the FPC 30. Then, the respective terminals of the upper and lower rows of signal terminals 21*a,* 21*b,* 22*a* and 22*b* are electrically connected by soldering. The locations of the soldering connections are on the lower surface 34*a* of the first section 31 of the FPC 30 for the upper rows of signal terminals 21*a* and upper row of ground terminals 21*b* constituting the upper row of terminals 21, and on the upper surface 33*b* of the second section 32 of the FPC 30 for the lower rows of signal terminals 22*a* and lower row of ground terminals 22*b* constituting the lower rows of terminals 22. As a result, the upper rows of signal terminals 21*a* are electrically connected to the signal conductive pads 35*a* on the upper surface 33*a* of the first section 31 of the FPC 30, the upper row of ground terminals 21*b* are electrically connected to the ground surface 41 on the lower surfaces 34*a,* 34*b* of the FPC 30, the lower rows of signal terminals 22*a* are electrically connected to the signal conductive pads 35*b* on the upper surface 33*b* of the second section 32 of the FPC 30, and the lower row of ground terminals 22*b* are electrically connected to the ground surface 41 on the lower surfaces 34*a,* 34*b* of the FPC 30. Since the ground conductive pads 36*a,* 36*b* are electrically connected to the ground surfaces 41 via the ground through-holes 39*a,* 39*b,* the upper row of ground terminals 21*a* and lower row of ground terminals 21*b* are electrically connected to the ground conductive pads 36*a,* 36*b* formed on the upper surface 33 of the FPC 30.

Thus, in the electrical connector 1 of the present invention, in order to connect both sections 31, 32 of the FPC 30 to the upper rows of terminals 21 and lower rows of terminals 22, it is sufficient to construct a sub-assembly in which the FPC 30 is folded back to clamp the slider 50 between the sections 31, 32, then the upper rows of terminals 21 and lower rows of terminals 22 are electrically connected to the sections 31, 32. Accordingly, the connection work is simple. Furthermore, since the housing 10 to which the upper rows of terminals 21 and lower rows of terminals 22 are secured is a single integral member which is molded from an insulating resin material, the number of housing parts is small, and parts control is easy. Moreover, a single mold is sufficient so that manufacturing costs are low.

In the electrical connector of the present invention, a lower surface of a second section of a flexible printed circuit is folded back and fastened to a lower surface of a first section of the flexible printed circuit, and prescribed electrical terminals among a plurality of electrical terminals are electrically connected to conductive pads on an upper surface of the first section of the flexible printed circuit, while the other electrical terminals among the plurality of electrical terminals are electrically connected to conductive pads on an upper surface of a second section of the flexible printed circuit via the first section of the flexible printed circuit. Accordingly, in order to electrically connect both sections of the flexible printed circuit to the plurality of electrical terminals attached to a housing, it is sufficient to construct a sub-assembly, in which the flexible printed circuit is folded back to clamp a slider therein. Consequently, the electrical connection work is simple, and by extension, the assembly of the electrical connector is simple.

Furthermore, in the electrical connector of the present invention, the prescribed electrical terminals among the plurality of electrical terminals and the other electrical terminals among the plurality of electrical terminals are arranged in different rows, and the housing is a single integral member which is formed by molding from an insulating resin material. Accordingly, even in cases where the housing has at least two rows of electrical terminals, the number of housing parts is small, so that parts control is easy. Moreover, a single mold is sufficient, so that manufacturing costs are low.

Additionally, in the electrical connector according to the present invention, positioning-pin holes, which allow the passage of positioning pins therethrough that position the second section and first section of the flexible printed circuit when the lower surface of the second section is fastened to the lower surface of the first section, are located in the first section and second section of the flexible printed circuit. Accordingly, the lower surface of the second section of the flexible printed circuit can be simply and suitably fastened to the lower surface of the first section.

What is claimed is:

1. An electrical connector comprising:

an insulating housing having a plurality of electrical terminals protruding from a wall thereof;

a flexible printed circuit having a generally rectangular shape and divided at a center thereof into a first section and a second section;

conductive pads on an upper surface of the flexible printed circuit extending thereacross on each side of a center line of the flexible printed circuit so that first conductive pads are located on the first section and second conductive pads are located on the second section;

a slider member disposed on a lower surface of the second section and the first section is folded back and fastened to the second section so that lower surfaces of the first and second sections extend along each other with the slider member therebetween adjacent the center line; and wherein the first section is positioned between the wall and the second section along a portion of the wall and each end of the first section and the second section is electrically connected to the plurality of the electrical terminals with prescribed electrical terminals of the plurality of electrical terminals being electrically connected to the first conductive pads on the upper surface of the first section and prescribed electrical terminals of the plurality of electrical terminals being electrically connected to the second conductive pads on the upper surface of the second section.

2. An electrical connector as claimed in claim 1, wherein the prescribed electrical terminals electrically connected to the first conductive pads and the prescribed electrical terminals electrically connected to the second conductive pads are arranged in different rows.

3. An electrical connector as claimed in claim 1, wherein the first section and the second section have positioning holes through which positioning pins are inserted to position the first section onto the second section when the first section is folded back and fastened to the second section.

4. An electrical connector as claimed in claim 1, wherein supporting members are located on the housing for supporting the slider member.

5. An electrical connector as claimed in claim 4, wherein the slider member has supporting projections disposed in slots in the supporting members.

6. An electrical connector as claimed in claim 5, wherein lugs are provided on the slider member in engagement with the wall of the insulating housing.

7. An electrical connector as claimed in claim 2, wherein the end of the first section is electrically connected to a plurality of upper rows of electrical terminals, and the end of the second section is electrically connected to a plurality of lower rows of electrical terminals.

8. An electrical connector as claimed in claim 1, wherein the conductive pads will electrically engage with electrical contacts of a matable electrical connector.

9. An electrical connector as claimed in claim 6, wherein protrusions are located on the slider member in engagement with projecting members on the first section and the second section.

* * * * *